US008620205B2

(12) United States Patent
Higashi et al.

(10) Patent No.: US 8,620,205 B2
(45) Date of Patent: Dec. 31, 2013

(54) IMAGE FORMATION APPARATUS, IMAGE FORMATION SYSTEM, AND OUTPUT CONTROL METHOD

(75) Inventors: Natsuyo Higashi, Toyokawa (JP); Satoru Sasaki, Toyokawa (JP); Yoshiki Katayama, Toyokawa (JP); Hiroaki Takatsu, Nishio (JP); Hirotada Seki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 358 days.

(21) Appl. No.: 13/035,228

(22) Filed: Feb. 25, 2011

(65) Prior Publication Data

US 2011/0222895 A1 Sep. 15, 2011

(30) Foreign Application Priority Data

Mar. 15, 2010 (JP) ..... 2010-057608

(51) Int. Cl.
*G03G 15/00* (2006.01)

(52) U.S. Cl.
USPC ..... 399/407; 399/361

(58) Field of Classification Search
USPC ..... 399/407, 361
See application file for complete search history.

(56) References Cited

U.S. PATENT DOCUMENTS

| | | | | |
|---|---|---|---|---|
| 6,219,502 | B1 * | 4/2001 | Osari et al. | 399/82 |
| 7,113,296 | B1 * | 9/2006 | Tomidokoro et al. | 358/1.15 |
| 2002/0076232 | A1 * | 6/2002 | Taneko | 399/88 |
| 2005/0135830 | A1 | 6/2005 | Koyama | |
| 2007/0053024 | A1 | 3/2007 | Kitao | |
| 2007/0212103 | A1 * | 9/2007 | Kikuchi | 399/88 |
| 2008/0031651 | A1 * | 2/2008 | Watanabe et al. | 399/88 |
| 2009/0310982 | A1 | 12/2009 | Mano et al. | |

FOREIGN PATENT DOCUMENTS

| | | | |
|---|---|---|---|
| JP | 61-123860 | A | 6/1986 |
| JP | 4-119896 | A | 4/1992 |
| JP | 4-213711 | A | 8/1992 |
| JP | 2004-144783 | A | 5/2004 |

(Continued)

OTHER PUBLICATIONS

Office Action (Notice of Grounds of Rejection) dated Aug. 7, 2012, issued by the Japanese Patent Office in corresponding Japanese Patent Application No. 2010-057608, and an English translation thereof. (7 pages).

(Continued)

*Primary Examiner* — Walter L Lindsay, Jr.
*Assistant Examiner* — Roy Y Yi
(74) *Attorney, Agent, or Firm* — Buchanan Ingersoll & Rooney PC

(57) ABSTRACT

An image formation apparatus is connectable to a post processing apparatus for performing a post process to a sheet. The image formation apparatus includes: a power source for outputting a voltage to a first load and a second load, the first load being provided in the image formation apparatus and being involved in image formation, the second load being provided in the post processing apparatus and being involved in the post process; a power source controller for increasing the output voltage of the power source during an operation of the second load; and a load controller for controlling an operation of the first load such that an output of the first load falls within a predetermined range during the operation of the second load.

29 Claims, 11 Drawing Sheets

(56) References Cited

FOREIGN PATENT DOCUMENTS

| | | | |
|---|---|---|---|
| JP | 2005-221900 | A | 8/2005 |
| JP | 2005-345663 | A | 12/2005 |
| JP | 2006-007581 | A | 1/2006 |
| JP | 2007-102189 | A | 4/2007 |
| JP | 2008-58915 | A | 3/2008 |
| JP | 2008-077420 | A | 4/2008 |
| JP | 2008-180751 | A | 8/2008 |
| JP | 2009-17724 | A | 1/2009 |
| JP | 2009-301044 | A | 12/2009 |

OTHER PUBLICATIONS

Office Action (Notice of Grounds of Rejection) dated Feb. 28, 2012, issued in the corresponding Japanese Patent Application No. 2010-057608, and an English Translation thereof. (7 pages).

Office Action (Decision to Grant Patent) dated Jan. 22, 2013, issued in corresponding Japanese Patent Application No. 2010-057608, and an English Translation thereof. (6 pages).

* cited by examiner

IMAGE FORMATION APPARATUS, IMAGE FORMATION SYSTEM, AND OUTPUT CONTROL METHOD

This application is based on Japanese Patent Application No. 2010-057608 filed with the Japan Patent Office on Mar. 15, 2010, the entire content of which is hereby incorporated by reference.

BACKGROUND OF THE INVENTION

1. Field of the Invention

The present invention relates to an image formation apparatus, an image formation system, and an output control method. In particular, the present invention relates to an image formation apparatus to which a post processing apparatus is connected; an image formation system including the image formation apparatus and the post processing apparatus; and an output control method in the image formation apparatus.

2. Description of the Related Art

In recent years, in order to deal with various printing styles, image formation systems for continuously performing processes from printing to a post process such as bookbinding have been pervasive.

For such an image formation system, Japanese Laid-Open Patent Publication No. 2008-077420 (hereinafter, referred to as "Patent Document 1") discloses an image formation system including: a power supply line for supplying power, which has been supplied to a post processing apparatus from an apparatus of a previous stage, to an apparatus of a subsequent stage; and boosting means for increasing voltage of the power thus supplied. The post processing apparatus includes: voltage monitoring means for monitoring an output voltage level in the power supply line thus adapted to supply the power to the apparatus of the subsequent stage; and boosting control means for causing the boosting means to increase the voltage when a result of the monitoring by the voltage monitoring means is smaller than a predetermined output voltage level.

In Patent Document 1, such a configuration prevents the post processing apparatus from being influenced by voltage drop resulting from impedance in the power supply line.

Meanwhile, Japanese Laid-Open Patent Publication No. 2005-345663 (hereinafter, referred to as "Patent Document 2") discloses a power saving method for stopping a part of driving units of an image formation apparatus in synchronism with a period during which power consumption of a sheet post processing unit is at maximum.

Meanwhile, Japanese Laid-Open Patent Publication No. 2006-007581 (hereinafter, referred to as "Patent Document 3") discloses an image formation apparatus having a power source for driving an image controller or a CPU (Central Processing Unit) using a DC/DC converter of separate excitation type. When powered on, the DC/DC converter included in the image formation apparatus detects an option for supply of sheets and a status regarding incorporation of an external device such as an image scanner, estimates a load current, and drives it at an optimum PWM frequency. In this way, power consumption is reduced in the image formation apparatus.

SUMMARY OF THE INVENTION

In the case where an image formation system is configured to supply power from a switching power source of an image formation apparatus to a post processing apparatus, the following problem takes place.

Based on execution of a post process in the post processing apparatus, voltage supplied from the image formation apparatus to the post processing apparatus is dropped. Likewise, voltage is also dropped which is supplied to each load in the image formation apparatus (such as a developing device, a transferring device, a fixing device, and a motor for driving a sheet transporting unit). Here, a distance from the switching power source to the post processing apparatus is longer than a distance from the switching power source to each load in the image formation apparatus. In other words, an impedance between the switching power source and the post processing apparatus is larger than an impedance between the switching power source and each load in the image formation apparatus. Accordingly, the voltage drop value of the voltage supplied to the post processing apparatus is larger than the voltage drop value of the voltage supplied to each load in the image formation apparatus.

In this case, when the image formation apparatus controls to increase the voltage to be supplied to the post processing apparatus, the voltage to be supplied to each load in the image formation apparatus is also increased. Meanwhile, when the voltage to be supplied to each load in the image formation apparatus is thus changed, an output from each load becomes unstable, with the result that images cannot be formed with high precision.

However, the arts disclosed in Patent Documents 1-3 do not contemplate such decreased image precision resulting from increasing the voltage to be supplied to the post processing apparatus.

According to an aspect of the present invention, an image formation apparatus is an image formation apparatus connectable to a post processing apparatus for performing a post process to a sheet. The image formation apparatus includes: a power source for outputting a voltage to a first load and a second load, the first load being provided in the image formation apparatus and being involved in image formation, the second load being provided in the post processing apparatus and being involved in the post process; a power source controller for increasing the output voltage of the power source during an operation of the second load; and a load controller for controlling an operation of the first load such that an output of the first load falls within a predetermined range during the operation of the second load.

Preferably, the first load is an HV load including a developing device or a transferring device.

Preferably, the first load includes a motor load for driving a transporting unit for transporting a sheet on which an image is to be formed.

Preferably, the second load is a stapling process load for providing a stapling process to a sheet having an image formed thereon, or a shift process load for providing a shift process to the sheet having the image formed thereon.

Preferably, the image formation apparatus further includes a communication interface for receiving, from the post processing apparatus, information indicating a change in the voltage supplied to the second load during the operation of the second load. Based on the information indicating the change, the power source controller determines a degree of increase of the output voltage of the power source.

Preferably, based on the information indicating the change, the load controller controls the operation of the first load.

Preferably, the load controller controls the operation of the first load based on the degree of increase of the output voltage of the power source, the degree of increase having been determined by the power source controller.

Preferably, when a change in the voltage during the operation of the second load is not less than a predetermined value, the power source controller controls to increase the output voltage of the power source, and when the change in the voltage during the operation of the second load is less than the predetermined value, the power source controller does not control to increase the output voltage of the power source.

Preferably, the operation of the first load is controlled by modulating a pulse width of a control signal input thereto. The load controller controls the operation of the first load by changing a duty ratio in the control signal.

Preferably, during a first operation of the second load, the power source controller increases the output voltage of the power source by a predetermined degree, and during a second or later operation of the second load, the power source controller corrects the predetermined degree based on a change, taking place at a timing of the first operation, in the voltage supplied to the second load, and increases the output voltage of the power source by the predetermined degree thus corrected.

According to another aspect of the present invention, an image formation system is an image formation system including a post processing apparatus for performing a post process to a sheet, and an image formation apparatus connected to the post processing apparatus. The image formation apparatus includes a power source for outputting a voltage to a first load and a second load, the first load being provided in the image formation apparatus and being involved in image formation, the second load being provided in the post processing apparatus and being involved in the post process, a power source controller for increasing the output voltage of the power source during an operation of the second load, and a load controller for controlling an operation of the first load such that an output of the first load falls within a predetermined range during the operation of the second load. The post processing apparatus transmits, to the image formation apparatus, information indicating a change in the voltage supplied to the second load during the operation of the second load. The image formation apparatus receives the information indicating the change, from the post processing apparatus. The power source controller determines, based on the information indicating the change, a degree of increase of the output voltage of the power source.

Preferably, the first load is an HV load including a developing device or a transferring device.

Preferably, the first load includes a motor load for driving a transporting unit for transporting a sheet on which an image is to be formed.

Preferably, the second load is a stapling process load for providing a stapling process to a sheet having an image formed thereon, or a shift process load for providing a shift process to the sheet having the image formed thereon.

Preferably, the load controller controls the operation of the first load based on the information indicating the change.

Preferably, the load controller controls the operation of the first load based on the degree of increase of the output voltage of the power source, the degree of increase having been determined by the power source controller.

Preferably, when the change in the voltage during the operation of the second load is not less than a predetermined value, the power source controller controls to increase the output voltage of the power source, and when the change in the voltage during the operation of the second load is less than the predetermined value, the power source controller does not control to increase the output voltage of the power source.

Preferably, the operation of the first load is controlled by modulating a pulse width of a control signal input thereto. The load controller controls the operation of the first load by changing a duty ratio in the control signal.

Preferably, during a first operation of the second load, the power source controller increases the output voltage of the power source by a predetermined degree. During a second or later operation of the second load, the power source controller corrects the predetermined degree based on a change, taking place at a timing of the first operation, in the voltage supplied to the second load, and increases the output voltage of the power source by the predetermined degree thus corrected.

According to still another aspect of the present invention, an output control method is an output control method in an image formation apparatus connectable to a post processing apparatus for performing a post process to a sheet. The output control method includes the steps of: a power source of the image formation apparatus outputting a voltage to a first load and a second load, the first load being provided in the image formation apparatus and being involved in image formation, the second load being provided in the post processing apparatus and being involved in the post process; a controller of the image formation apparatus increasing the output voltage of the power source during an operation of the second load; and the controller controlling an operation of the first load such that an output of the first load falls within a predetermined range during the operation of the second load.

Preferably, the first load is an HV load including a developing device or a transferring device.

Preferably, the first load includes a motor load for driving a transporting unit for transporting a sheet on which an image is to be formed.

Preferably, the second load is a stapling process load for providing a stapling process to a sheet having an image formed thereon, or a shift process load for providing a shift process to the sheet having the image formed thereon.

Preferably, the output control method further includes the step of the controller receiving, from the post processing apparatus, information indicating a change in the voltage supplied to the second load during the operation of the second load. The step of increasing the output voltage includes the step of determining a degree of increase of the output voltage of the power source based on the information indicating the change.

Preferably, the step of controlling the operation of the first load controls the operation of the first load based on the information indicating the change.

Preferably, the step of controlling the operation of the first load controls the operation of the first load based on the determined degree of increase of the output voltage of the power source.

Preferably, the step of increasing the output voltage includes the steps of: controlling to increase the output voltage of the power source when a change in the voltage during the operation of the second load is not less than a predetermined value, and not controlling to increase the output voltage of the power source when the change in the voltage during the operation of the second load is less than the predetermined value.

Preferably, the operation of the first load is controlled by modulating a pulse width of a control signal input thereto. The step of controlling the operation of the first load controls the operation of the first load by changing a duty ratio in the control signal.

Preferably, the step of increasing the output voltage further includes the steps of: during a first operation of the second load, increasing the output voltage of the power source by a predetermined degree, and during a second or later operation of the second load, correcting the predetermined degree based on a change, taking place at a timing of the first operation, in the voltage supplied to the second load, and increasing the output voltage of the power source by the predetermined degree thus corrected.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
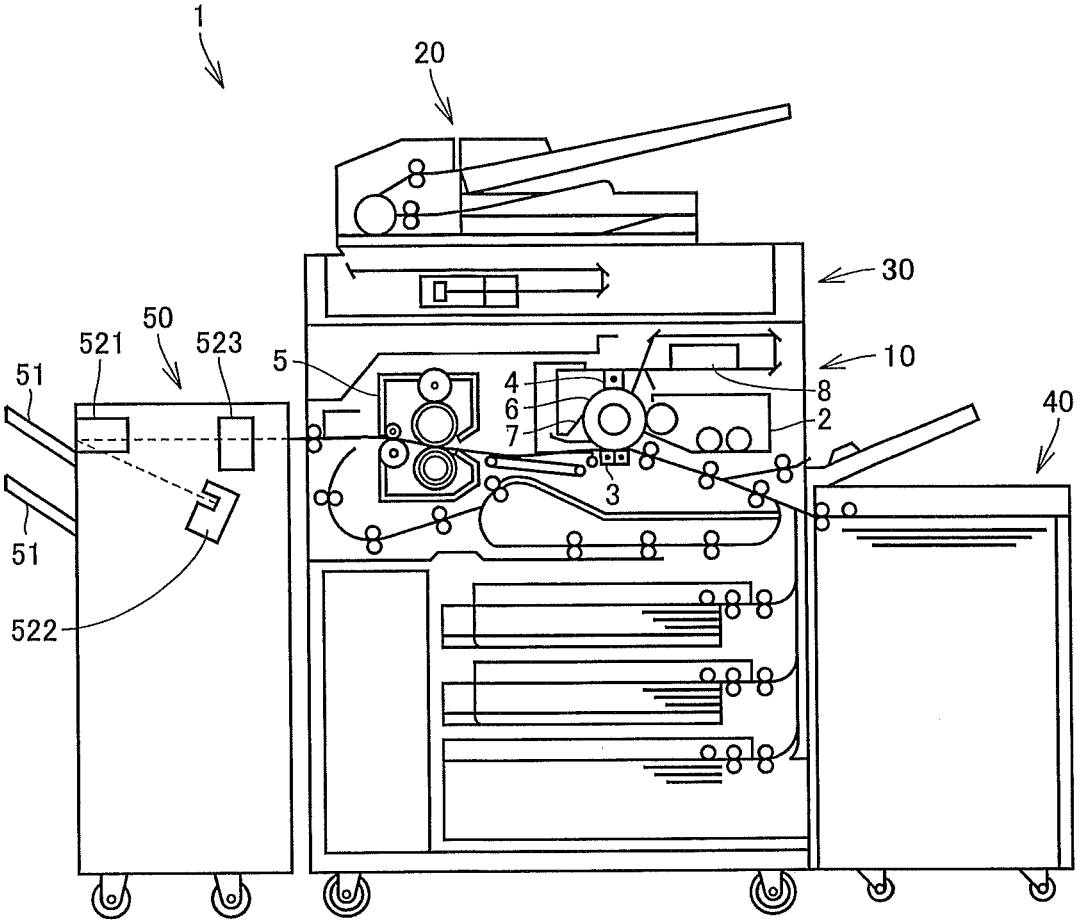
FIG. 1 illustrates a configuration of an image formation system.

The following describes an image formation system according to an embodiment of the present invention, with reference to figures. In the description below, the same components are given the same reference characters. Their names and functions are the same, Hence, they are not described repeatedly in detail.

<Overview of Image Formation System>

FIG. 1 illustrates a configuration of an image formation system 1. Referring to FIG. 1, image formation system 1 includes an image formation apparatus 10, an ADF (auto document feeder) 20, an image scanning apparatus 30, a sheet supplying apparatus 40, and a post processing apparatus 50.

ADF 20 is an apparatus for automatically feeding and transporting a document to a predetermined scanning location, in which the document thus transported is scanned by an optical system. Image scanning apparatus 30 scans a document placed on a platen, or scans a document delivered thereto from the ADF. Sheet supplying apparatus 40 supplies a sheet (recording sheet) to image formation apparatus 10 based on an instruction from image formation apparatus 10. Post processing apparatus 50 is an apparatus for providing a post process to a sheet having an image formed thereon by image formation apparatus 10. Post processing apparatus 50 includes trays 51 receiving sheets ejected, a shift process load 521, a stapling process load 522, and a punch process load 523. Details of shift process load 521, stapling process load 522, and punch process load 523 will be described later.

ADF 20, image scanning apparatus 30, sheet supplying apparatus 40, post processing apparatus 50, and image formation apparatus 10 are electrically and structurally connected to one another. ADF 20, image scanning apparatus 30, sheet supplying apparatus 40, and post processing apparatus 50 operate based on instructions from the image formation apparatus.

Image formation apparatus 10 has a plurality of loads such as a developing device 2, a transferring device 3, a charging device 4, a fixing device 5, a photo conductor 6, a cleaner 7, an exposure device 8, a motor for driving a sheet transporting unit, and the like.

Developing device 2 is a device for adhering toner to photo conductor 6 on which an electrostatic latent image is formed. Transferring device 3 is a device for transferring the adhered toner from the photo conductor to a sheet. Charging device 4 is a device for charging photo conductor 6. Fixing device 5 is a device for fixing the toner to the sheet by applying heat to melt the toner transferred and adhered to the sheet, and applying pressure thereto. Photo conductor 6 is formed of a-Si (amorphous silicon) or the like. Cleaner 7 is a device for removing toner adhered to photo conductor 6, and collects the removed toner. Exposure device 8 is a device for forming an electrostatic latent image on a surface of photo conductor 6. The sheet transporting unit is a structure for transporting a sheet from sheet supplying apparatus 40 to a tray 51.

Figure 11:
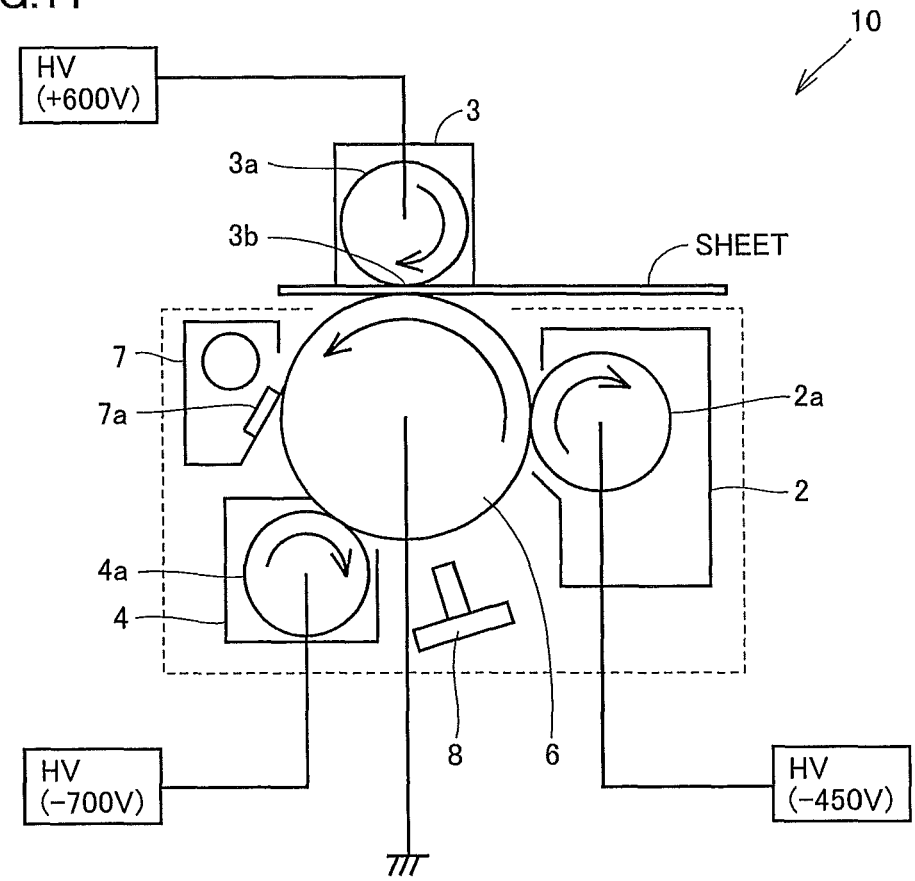
FIG. 11 is an enlarged view of a portion of the image formation apparatus.

FIG. 11 is an enlarged view of a portion of image formation apparatus 10. Referring to FIG. 11, developing device 2 includes a developing roller 2*a*. Transferring device 3 includes a transferring roller 3*a*. Charging device 4 includes a charging roller 4*a*. Cleaner 7 includes a cleaning blade 7*a*. Photo conductor 6 is grounded. It should be noted that each of developing roller 2*a*, transferring roller 3*a*, and charging roller 4*a* is driven by a motor. Charging roller 4*a* is moved according to rotation of photo conductor 6.

Image formation in image formation apparatus 10 is performed as follows. First, charging roller 4*a* charges the surface of photo conductor 6. Then, exposure device 8 exposes the charged photo conductor 6 to light. Charges are dissipated from portions exposed to the light in photo conductor 6. Then, developing roller 2*a* adheres the toner, which is contained in developing device 2, to photo conductor 6. Accordingly, a toner image is formed on the portions exposed to the light in photo conductor 6. Meanwhile, the sheet transporting unit transports a sheet to a nip portion 3*b* formed by photo conductor 6 and transferring roller 3*a*. Here, by electric field between photo conductor 6 and transferring roller 3*a* in nip portion 3*b*, the toner on photo conductor 6 is transferred to the sheet. In this state, the toner is just placed on the sheet, and is therefore melted to be fixed onto the sheet by heating the sheet and applying pressure thereto using a fixing roller. Remaining toner having not been transferred from photo conductor 6 to the sheet will result in decreased quality of an image to be formed next. Hence, the toner thus remaining on the surface of photo conductor 6 is cleaned by cleaning blade 7*a*.

Figure 2:
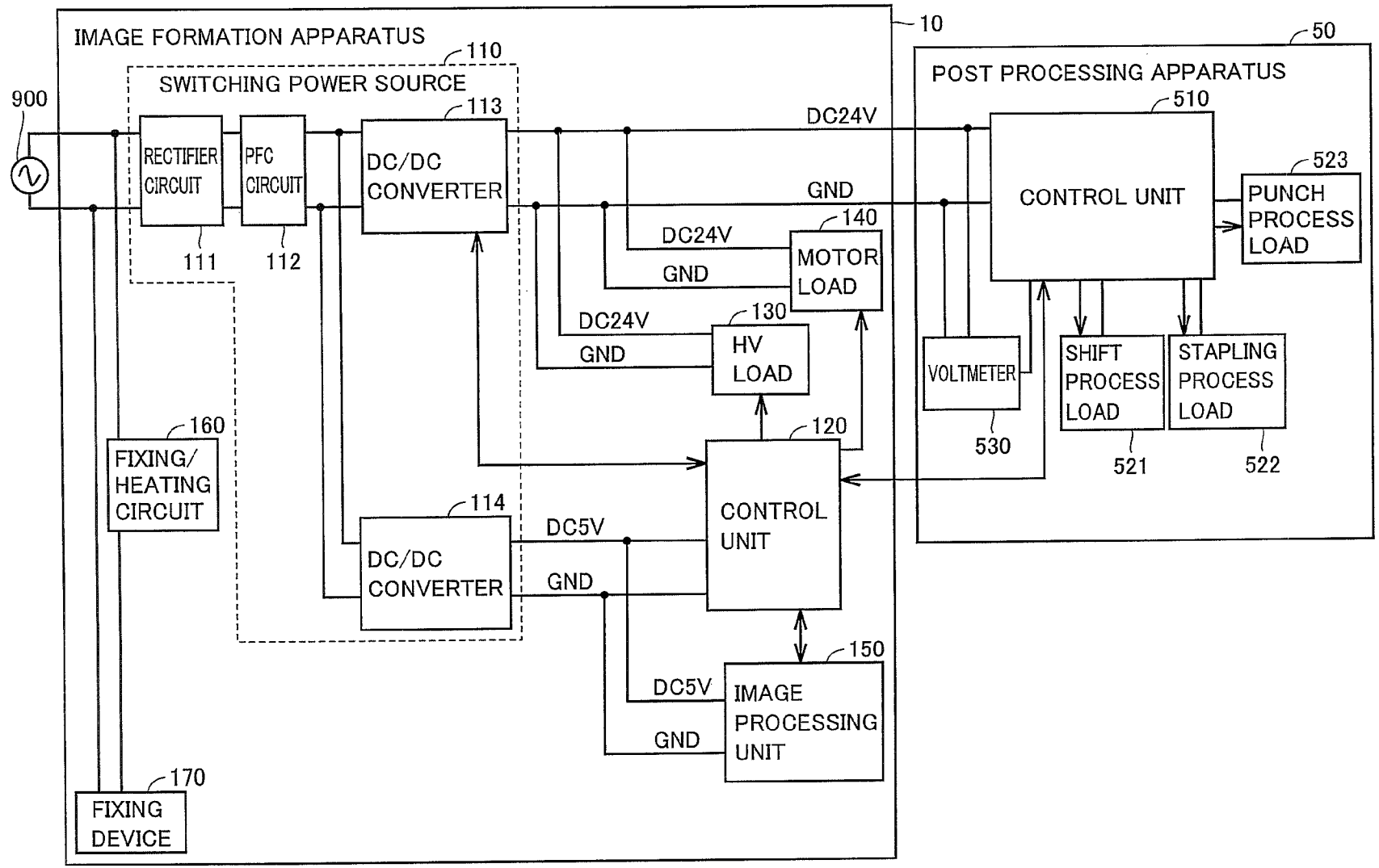
FIG. 2 is a block diagram for illustrating respective configurations of an image formation apparatus and a post processing apparatus.

FIG. 2 is a block diagram for illustrating respective configurations of image formation apparatus 10 and post processing apparatus 50. In the description below, image formation apparatus 10 will be explained first, and post processing apparatus 50 will be explained next.

Referring to FIG. 2, image formation apparatus 10 operates using an alternating-current power source 900, which is a commercial power source, for example. Image formation apparatus 10 includes a switching power source 110, a control unit 120, an HV (High Voltage) load 130, a motor load 140, an image processing unit 150, a fixing/heating circuit 160, and a fixing device 170. Switching power source 110 includes a rectifier circuit 111, a PFC (Power Factor Correction) circuit 112, a DC/DC converter 113, and a DC/DC converter 114. It should be noted that the loads included in image formation apparatus 10 are not limited to these two loads (HV load 130 and motor load 140).

Switching power source 110 sends direct-current voltages to each load 130, 140, control unit 120, image processing unit 150, and post processing apparatus 50, Specifically, switching power source 110 sends a direct-current voltage of 24 V to each load 130, 140 and post processing apparatus 50, and sends a direct-current voltage of 5 V to control unit 120 and image processing unit 150.

Hereinafter, details of switching power source 110 will be described. Rectifier circuit 111 converts the alternating-current voltage, which is supplied from alternating-current power source 900, into a direct-current voltage. PFC circuit 112, which is connected to rectifier circuit 111, improves a power factor. The power factor is a numerical value indicating how large reactive current is required to send power.

DC/DC converter 113, which is connected to PFC circuit 112, converts the input direct-current voltage into the direct-current voltage of 24 V. DC/DC converter 113 sends the converted direct-current voltage of 24 V to each load 130, 140 and post processing apparatus 50.

DC/DC converter 114, which is connected to PFC circuit 112, converts the input direct-current voltage into the direct-current voltage of 5 V. DC/DC converter 114 sends the converted direct-current voltage of 5 V to control unit 120 and image processing unit 150.

It should be noted that DC/DC converter 113 and DC/DC converter 114 are connected to PFC circuit 112 in parallel. It should be also noted that DC/DC converter 113 and DC/DC converter 114 are capable of adjusting the output direct-current voltages by means of PWM (Pulse Width Modulation) control.

Figure 7:
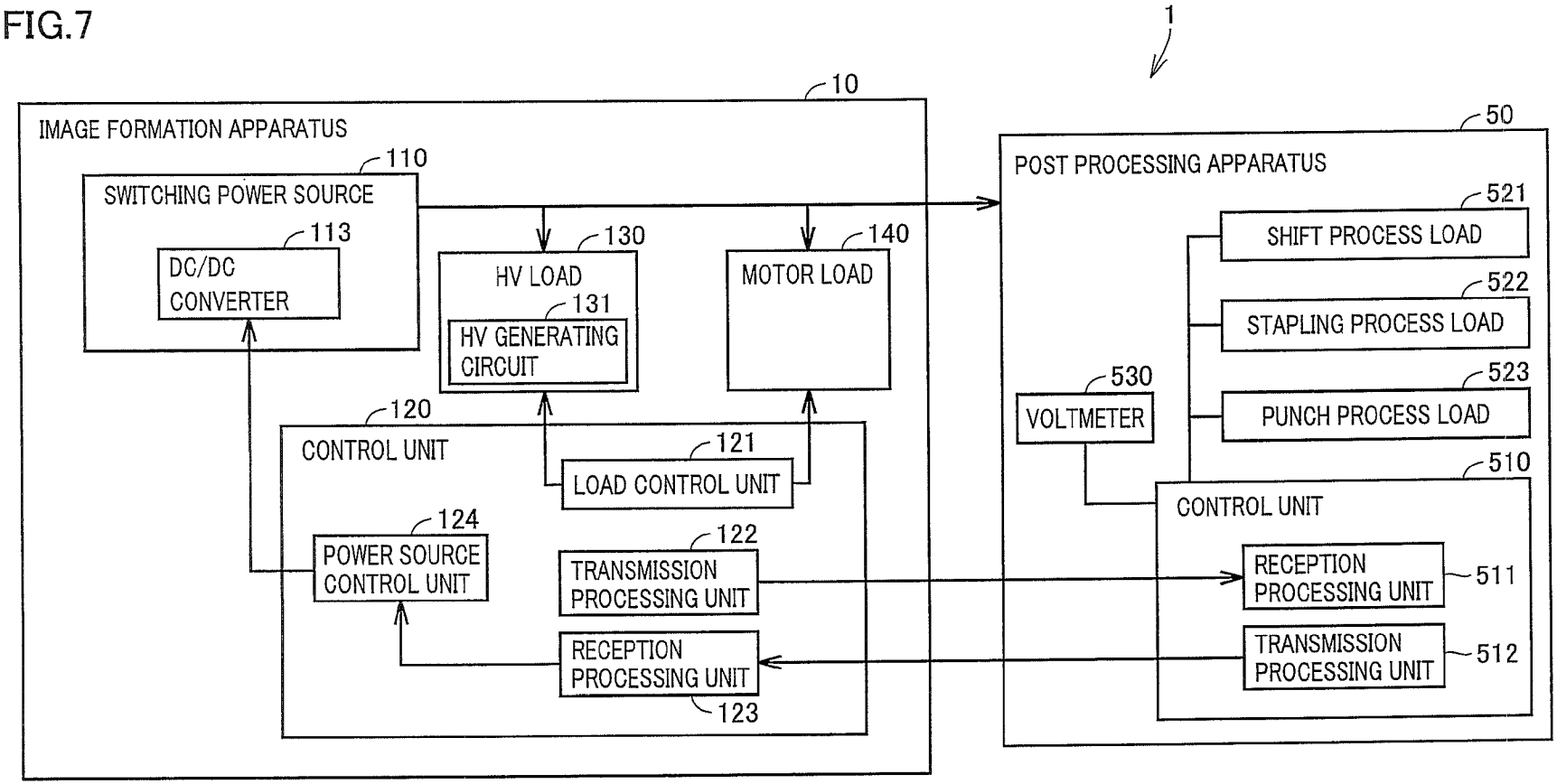
FIG. 7 is a block diagram showing a specific configuration of the control unit of the image formation apparatus.

Control unit 120 controls operations of image formation apparatus 10. For example, control unit 120 controls operations of DC/DC converter 113, each load 130, 140, and image processing unit 150. Further, control unit 120 communicates with post processing apparatus 50, using a communication interface. For example, when image formation apparatus 10 receives, via an operation panel (not shown), a user's instruction for a post process, control unit 120 instructs post processing apparatus 50 to perform the post process. Details of control unit 120 will be described later (FIG. 7 and the like).

Image formation apparatus 10 employs an HV generating circuit 131 (see FIG. 7) to generate a HV (for example, +600V) based on the output of 24 V from DC/DC converter 113, and applies the generated HV to HV load 130. HV load 130 functions in response to the application of the HV. HV load 130 is, for example, developing device 2, transferring device 3, or charging device 4. Motor load 140 is a motor for driving a member included in image formation apparatus 10 (for example, the motor for driving the sheet transporting unit). Further, HV load 130 adjusts an output (hereinafter, also referred to as "HV output") of the HV load by means of PWM control.

Here, when HV load 130 is transferring device 3, the HV output corresponds to a voltage in nip portion 3*b* of transferring device 3 (see FIG. 11) (transferring voltage: voltage between transferring roller 3*a* and photo conductor 6). Since the same applies to the other HV loads, explanation therefor will not be repeated.

Image processing unit 150 provides a predetermined image process onto an image captured by image scanning apparatus 30. Based on the image data having been through the image process, image formation apparatus 10 forms a corresponding image on a sheet.

Fixing device 170 heats and melts the toner image to fix the image onto the sheet. Fixing/heating circuit 160 is a circuit for heating fixing device 170 for the fixing process in fixing device 170.

Next, post processing apparatus 50 will be described. Post processing apparatus 50 performs the post process onto the sheet having the image formed thereon. Post processing apparatus 50 includes control unit 510, shift process load 521, stapling process load 522, punch process load 523, and a voltmeter 530. It should be noted that the loads included in post processing apparatus 50 are not limited to these three loads (shift process load 521, stapling process load 522, and punch process load 523).

Voltmeter 530 measures the voltage supplied to post processing apparatus 50, in real time. Voltmeter 530 transmits a result of the measurement to control unit 510.

Control unit 510 receives the direct-current voltage of 24 V output from image formation apparatus 10. Control unit 510 supplies the received direct-current voltage to each load 521-523. Thus, each load 521-523 receives power from switching power source 110. Further, control unit 510 controls operations of loads 521-523.

Control unit 510 employs a communication interface to notify control unit 120 of image formation apparatus 10 of an operating state of each load 521-523 or the like. Further, when control unit 510 receives an instruction for a post process from control unit 120 of image formation apparatus 10, control unit 510 transmits to control unit 120 a signal indicating a timing for the post process. It should be noted that control unit 510 determines the timing for the post process, based on matters specified in a job from image formation apparatus 10, such as the number of sheets to be subjected to image formation, what post process to be performed, or a timing for the image formation in image formation apparatus 10.

Control unit 510 detects fluctuation of the voltage supplied to post processing apparatus 50, based on the result of measurement provided by voltmeter 530. Control unit 510 transmits, to control unit 120 of image formation apparatus 10, a value (voltage drop value) indicating how much the voltage supplied to post processing apparatus 50 has been dropped from 24 V. It should be noted that the "voltage drop value" is information indicating a change in the voltage supplied to each load 521-523 of the post processing apparatus during the operations of the loads.

Shift process load 521 is a structure for changing the position of the sheet to be ejected to tray 51, in a direction perpendicular to the direction of ejection. Stapling process load 522 is a structure for providing a stapling process to the sheet having the image formed thereon. Punch process load 523 is a structure for creating a hole in the sheet having the image formed thereon.

Based on instructions from control unit 510, shift process load 521, stapling process load 522, and punch process load 523 respectively perform the shift process, the stapling process, and the punch process at instructed timings.

<Overview of Control>

Figure 3:
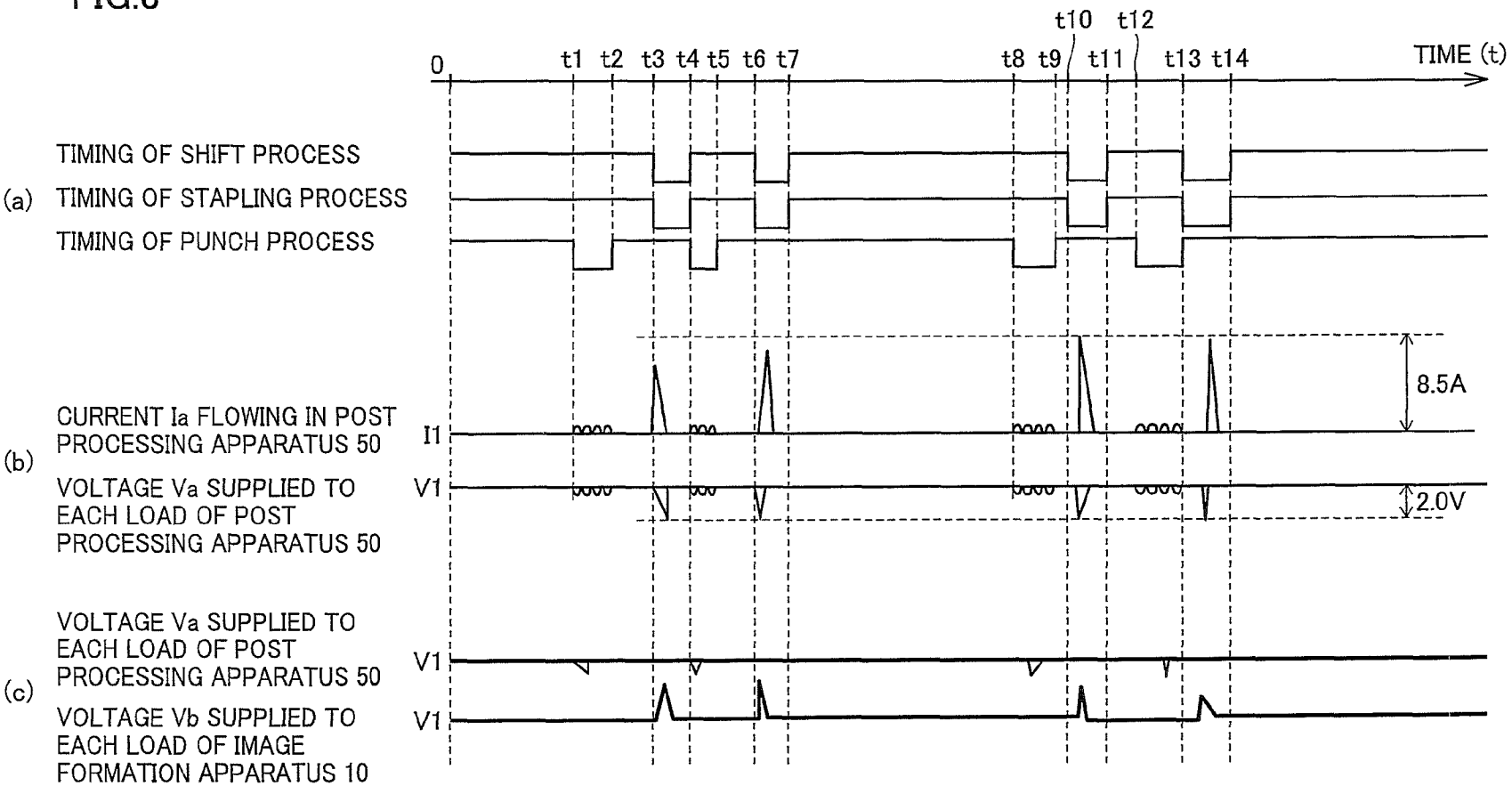
FIG. 3 is a timing chart for illustrating control of the image formation apparatus.

FIG. 3 is a timing chart for illustrating the control of image formation apparatus 10. FIG. 3(*a*) shows respective operation timings of loads 521-523 of post processing apparatus 50. Specifically, FIG. 3(*a*) shows timings at which post processing apparatus 50 performs the shift process, the stapling process, and the punch process. FIG. 3(*b*) illustrates voltage drop of the voltage supplied from DC/DC converter 113 to post processing apparatus 50. FIG. 3(*c*) shows the voltage supplied to each load 521-523 of post processing apparatus 50 and voltage supplied to each load 130, 140 of image formation apparatus 10, when the output voltage of DC/DC converter 113 is increased at a predetermined timing.

Referring to FIG. 3(*a*), post processing apparatus 50 performs the punch process during a period of time from t1 to t2, a period of time from t4 to t5, a period of time from t8 to t9, and a period of time from t12 to t13. It should be noted that t=0 corresponds to time at which the image formation is started. Further, post processing apparatus 50 performs the shift process and the stapling process during a period of time from t3 to t4, a period of time from t6 to t7, a period of time from t10 to t11, and a period of time from t13 to t14. In the case where the job is for a plurality of pages (sheets), the stapling process and the shift process are performed based on the plurality of sheets as a unit (bundle of sheets), whereas the punch process is performed for each sheet. However, for ease of description, the waveform for each process is illustrated in a similar manner in FIG. 3(*a*). Further, the shift process is performed slightly after the stapling process, but for ease of description, FIG. 3(*a*) shows that they are performed at the same timing. Further, the respective timings for the shift process, the stapling process, and the punch process are merely illustrative, and are not limited to those shown in FIG. 3(*a*).

In image formation system 1, in response to image formation apparatus 10 receiving one job, images are formed on sheets, which are then handled based on a predetermined number of sheets as a unit and are sequentially subjected to the post process.

Referring to FIG. 3(*b*), when post processing apparatus 50 starts the punch process at time t1, current Ia flowing in post processing apparatus 50 is increased from a current value I1. Current value I1 is a value of the current flowing in the post processing apparatus when no post process is performed. As the current is increased, voltage Va supplied from DC/DC converter 113 to each load 521-523 of post processing apparatus 50 is dropped from voltage V1. It should be noted that in the present embodiment, V1=24 V.

Also when post processing apparatus 50 starts the shift process and the stapling process at time t3, current Ia flowing in post processing apparatus 50 is abruptly increased from current value I1. As the current is increased, voltage Va supplied from DC/DC converter 113 to each load 521-523 of post processing apparatus 50 is dropped from voltage V1.

Such voltage drop takes place when the punch process, the shift process, and the stapling process are performed at the same timing or different timings. If post processing apparatus 50 performs the shift process and the stapling process at the same timing, an inrush current of 8.5 A at maximum flows in post processing apparatus 50, for example. In this case, the voltage is dropped by 2.0 V.

In the description below, for ease of explanation, it is assumed that the value of the voltage drop in the punch process is smaller than a predetermined value Vth. It is also assumed that the value of the voltage drop in the shift process with the stapling process not performed is larger than predetermined value Vth. Further, it is also assumed that the value of the voltage drop in the stapling process with the shift process not performed is larger than predetermined value Vth. This is due to the following reason. That is, because the punch process is performed to each sheet whereas the shift process and the stapling process are performed to each bundle of sheets as described above, the current flowing in the former process is smaller than those in the latter processes. As a result, the voltage drop in the former process is smaller than the voltage drop in each of the latter processes. Now, the following describes a case where the output voltage of DC/DC converter 113 is increased at a predetermined timing when performing the stapling process and the shift process at the same timing or different timings, because the voltage drop in the shift process and the voltage drop in the stapling process are larger than predetermined value Vth.

In order to reduce the voltage drop of the voltage supplied to post processing apparatus 50, control unit 120 of image formation apparatus 10 controls to increase the output voltage of DC/DC converter 113 during a period of time from t3 to t4, a period of time from t6 to t7, a period of time from t10 to t11, a period of time from t13 to t14 (hereinafter, also referred to as "periods of time from t3 to t4 and the like").

Referring to FIG. 3(*c*), voltage Va supplied from DC/DC converter 113 to each load 521-523 of the post processing apparatus is maintained substantially at V1 (24 V) during the periods of time from t3 to t4 and the like, by the above-described control for increasing the output voltage of DC/DC converter 113. On the other hand, voltage Vb supplied from DC/DC converter 113 to each load 130, 140 of image formation apparatus 10 is temporarily increased from voltage V1 during the periods of time from t3 to t4 and the like, by the above-described control for increasing the output voltage of DC/DC converter 113.

Figure 4:
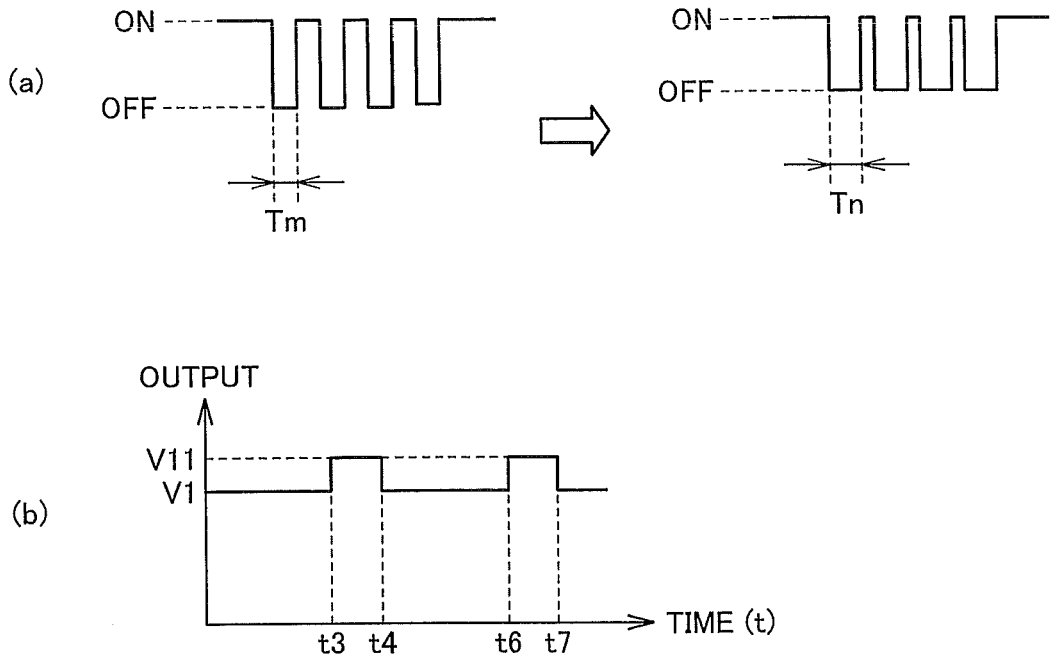
FIG. 4 illustrates a process for maintaining, at a certain value, a voltage supplied from a DC/DC converter.

FIG. 4 illustrates a process for maintaining, at a certain value, the voltage supplied from DC/DC converter 113 to each load 521-523 of the post processing apparatus. Namely, FIG. 4 illustrates a process for maintaining, at V1, the voltage supplied from DC/DC converter 113 to each load 521-523 of the post processing apparatus, during the periods of time from t3 to t4 and the like. FIG. 4(*a*) shows a switching frequency for DC/DC converter 113. FIG. 4(*b*) shows the output voltage of DC/DC converter 113.

DC/DC converter 113 is capable of adjusting its output voltage in accordance with the PWM control. Further, DC/DC converter 113 is capable of increasing its output voltage by increasing the duty of off time, and is also capable of reducing its output voltage by reducing the duty of off time.

Referring to FIG. 4(*a*), DC/DC converter 113 extends time of switch-on from time Tm to time Tn (off time in FIG. 4(*a*)) during the periods of time from t3 to t4 and the like. In other words, during the periods of time from t3 to t4 and the like, DC/DC converter 113 modulates pulse width thereof so as to make the off time longer than the on time. Referring to FIG. 4(*b*), during the periods of time from t3 to t4 and the like, DC/DC converter 113 outputs a voltage V11 higher than voltage V1. Accordingly, during the periods of time from t3 to t4 and the like, DC/DC converter 113 can maintain, at voltage V1, the voltage supplied to each load 521-523 of post processing apparatus 50, as shown in FIG. 3(*c*).

The description above has illustrated the case where the output voltage of DC/DC converter 113 is increased from voltage V1 (=24 V) to voltage V11 as shown in FIG. 4(*b*). In this case, the increase value of the voltage is a fixed value (V11-V1). However, determining an optimum fixed value in advance requires engineers' effort. In addition, the optimum fixed value may differ among image formation apparatuses. Furthermore, the optimum fixed value may differ among operation environments of image formation system 1. In view of these, the description below illustrates a configuration in which the increase value of the voltage is not a fixed value but is variable, with reference to FIG. 5.

Figure 5:
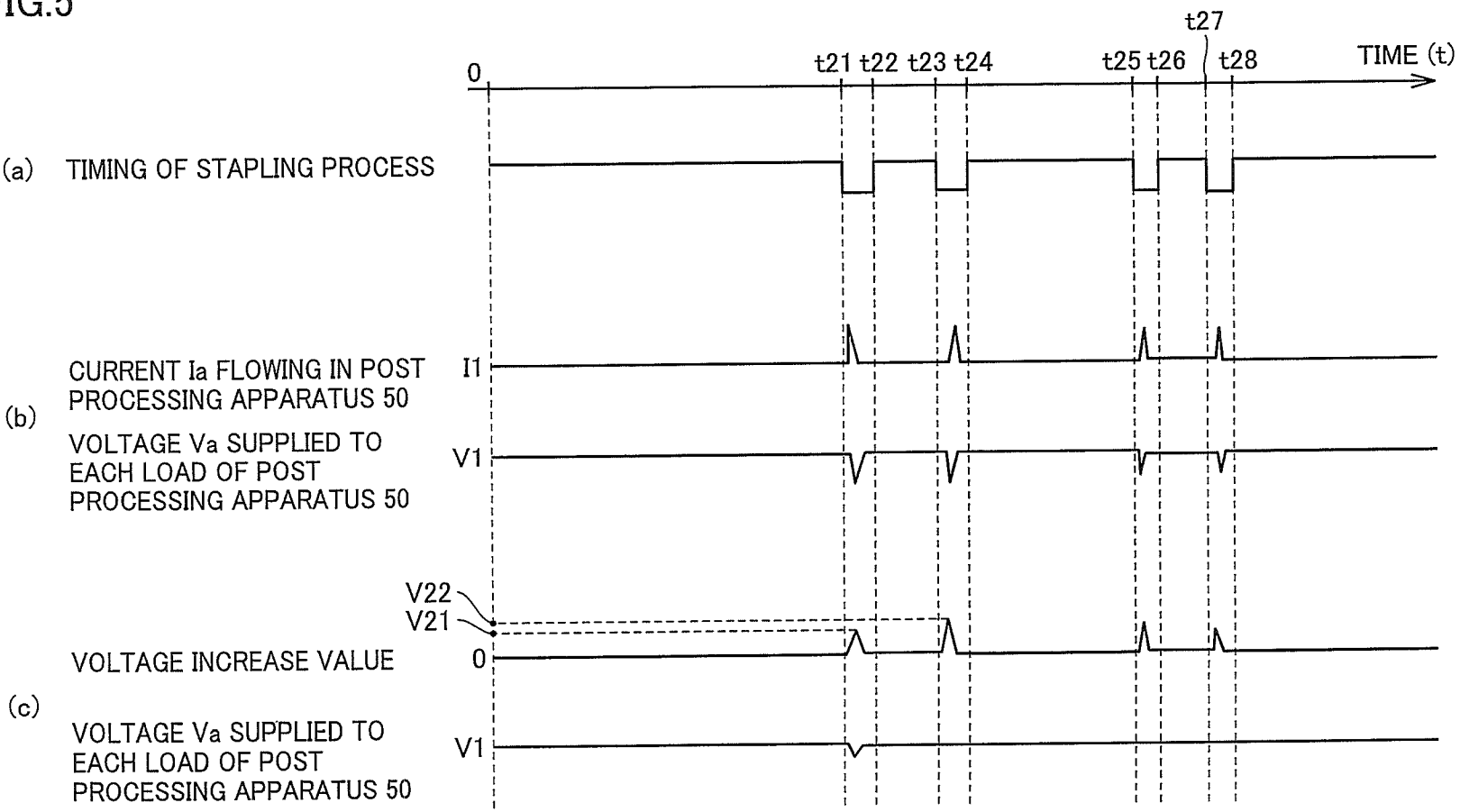
FIG. 5 is a timing chart for illustrating details of the control of the image formation apparatus.

FIG. 5 is a timing chart for illustrating details of control of image formation apparatus 10. FIG. 5 illustrates an exemplary case where post processing apparatus 50 only performs the stapling process. FIG. 5(*a*) shows timings for the stapling process. FIG. 5(*b*) illustrates voltage drop of the voltage supplied from DC/DC converter 113 to each load of post processing apparatus 50. FIG. 5(*c*) shows the voltage supplied to each load 521-523 of post processing apparatus 50 and the voltage supplied to each load 130, 140 of image formation apparatus 10, when the output voltage of DC/DC converter 113 is increased at a predetermined timing.

Referring to FIG. 5(*a*), post processing apparatus 50 performs the stapling process during a period of time from t21 to t22, a period of time from t23 to t24, a period of time from t25 to t26, and a period of time from t27 to t28 (hereinafter, also referred to as "periods of time from t21 to t22 and the like"). It should be noted that t=0 corresponds to time at which the image formation is started.

Referring to FIG. 5(*b*), when post processing apparatus 50 starts the stapling process at time t21, current Ia flowing in post processing apparatus 50 is abruptly increased from current value I1. As the current is increased, voltage Va supplied from DC/DC converter 113 to each load 521-523 of post processing apparatus 50 is dropped from voltage V1. Such voltage drop takes place during the periods of time from t21 to t22 and the like.

In order to reduce the voltage drop of the voltage supplied to post processing apparatus 50, control unit 120 of image formation apparatus 10 controls to increase the output voltage of DC/DC converter 113 during the periods of time from t21 to t22 and the like.

Referring to FIG. 5(*c*), control unit 120 controls to increase the output voltage of DC/DC converter 113 by a voltage V21 during the period of time from t21 to t22. It should be noted that voltage V21 is a predetermined value (hereinafter, also referred to as "reference value"). Further, control unit 120 receives, from post processing apparatus 50, the voltage drop value obtained during the period of time from t21 to t22.

When the output voltage of DC/DC converter 113 is increased by voltage V21 and the voltage supplied to post processing apparatus 50 goes below V1 (the voltage drop value received from post processing apparatus 50 is negative), control unit 120 corrects the increase value of the output voltage to a value larger than voltage V21. Further, when the output voltage of DC/DC converter 113 is increased by voltage V21 and the voltage supplied to post processing apparatus 50 goes above V1 (the voltage drop value received from post processing apparatus 50 is positive), control unit 120 corrects the increase value of the output voltage to a value smaller than voltage V21. For example, in the case of FIG. 5(*c*), control unit 120 corrects, based on the voltage drop value, the increase value of the output voltage of DC/DC converter 113 from voltage V21 to a voltage V22 (larger value).

By control unit 120 performing such a process, voltage Va supplied from DC/DC converter 113 to each load 521-523 of the post processing apparatus can be maintained substantially at V1 during the periods of time from t23 to t24, from t25 to t26, and from t27 to t28 even if voltage Va is above or is below V1 during the period of time from t21 to t22.

Here, a setting value (correction value) for HV load 130 will be described. As the setting value for HV load 130, control unit 120 determines a predetermined value when the increase value of the voltage of switching power source 110 (hereinafter, also referred to as "power source voltage") is as large as the reference value. When the increase value of the power source voltage is corrected, control unit 120 determined, as the setting value therefor, a value corresponding to the corrected increase value. An exemplary method for the determination is to allow control unit 120 to determine the setting value for HV load 130 with reference to a table stored in a ROM in advance and associating increase values of the power source voltage with setting values for the HV load. Further, the table thus stored in the ROM in advance may be a table associating voltage drop values and setting values for HV load 130, instead of the table associating the increase values of the power source voltage and the setting values of HV load 130. Control unit 120 transmits the determined setting value for HV load 130, to HV load 130 as a control signal that is based on the voltage drop value.

Referring to FIG. 3(*c*) again, as described above, voltage Vb supplied to each load 130, 140 of image formation apparatus 10 is temporarily increased from voltage V1 due to the control for increasing the output voltage of DC/DC converter 113. Such voltage increase is not preferable for stable operation of each load 130, 140. The following describes how to counteract such voltage increase.

HV load 130 is capable of adjusting the HV output in accordance with the PWM control. HV load 130 is capable of increasing the HV output by increasing the duty of off time, and is capable of reducing the HV output by reducing the duty of off time.

Figure 6:
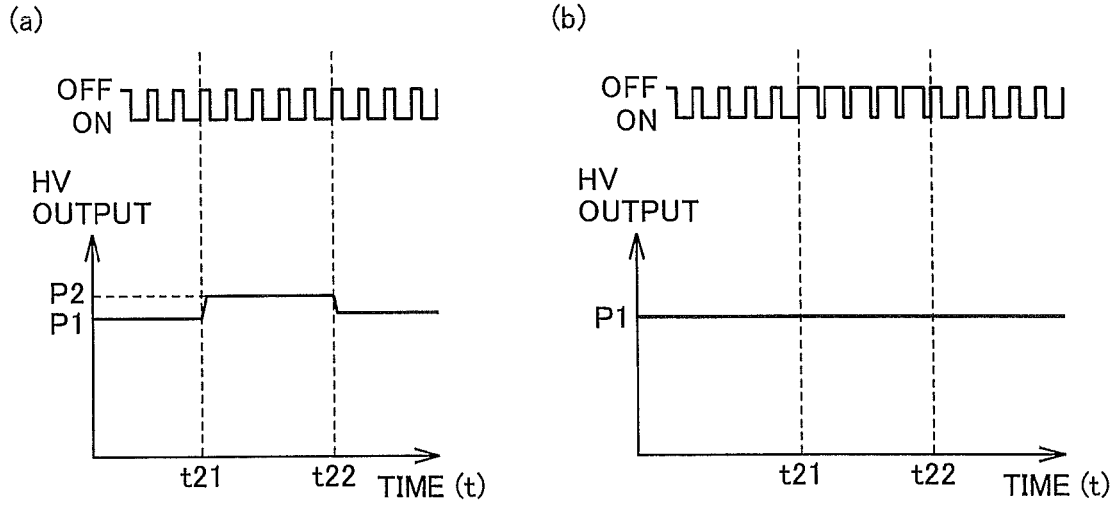
FIG. 6 illustrates control of a control unit over an HV load.

FIG. 6 illustrates the control of control unit 120 over HV load 130. FIG. 6(*a*) shows a relation between the control signal supplied to HV load 130 and the output of HV load 130 when the output of HV load 130 is not controlled. FIG. 6(*b*) shows a relation between the control signal supplied to HV load 130 and the output of HV load 130 when the output of HV load 130 is controlled.

Referring to FIG. 6(*a*), control unit 120 transmits to HV load 130 the control signal, which repeatedly becomes on/off with a certain cycle. The control signal causes the output of HV load 130 to increase from P1 to P2 during each period of time from t21 to t22, t23 to t24, t25 to t26, and t27 to t28 (see FIG. 5). The increase of the output thereof during the periods of time from t21 to t22, t23 to t24, t25 to t26, and t27 to t28 results from the increase of the voltage of DC/DC converter 113.

In order to reduce the increase of the output of HV load 130, control unit 120 changes the duty ratio of the control signal. Referring to FIG. 6(*b*), control unit 120 changes the duty ratio in each of the periods of time from t21 to t22, t23 to t24, t25 to t26, and t27 to t28 (see FIG. 5). Specifically, in the case of the figure, control unit 120 transmits to HV load 130 a control signal for increasing a ratio of off, during each of the periods of time from t21 to t22, from t23 to t24, from t25 to t26, and from t27 to t28. In this way, the output of HV load 130 is maintained at P1. It should be noted that a method for maintaining the output of HV load 130 at P1 will be described later.

It should be also noted that control of control unit 120 over motor load 140 will be described later. The following describes a functional configuration of each of control unit 120 and control unit 510 for implementing image formation system 1 described above, with reference to FIG. 7.

<Functional Configuration of Image Formation Apparatus>

FIG. 7 is a block diagram mainly showing the functional configuration of control unit 120 of image formation apparatus 10 and the functional configuration of control unit 510 of post processing apparatus 50. Referring to FIG. 7, image formation apparatus 10 includes switching power source 110, control unit 120, HV load 130, and motor load 140 as described above. Switching power source 110 includes DC/DC converter 113 as described above. HV load 130 includes HV generating circuit 131. HV generating circuit 131 is a circuit for generating the HV (for example, +600V) based on the voltage of 24V output from DC/DC converter 113, as described above. Control unit 120 includes load control unit 121, transmission processing unit 122, reception processing unit 123, and power source control unit 124. Each of transmission processing unit 122 and reception processing unit 123 has a function of a communication interface.

Post processing apparatus 50 includes control unit 510, each load 521-523, and voltmeter 530 as described above. Control unit 510 includes a reception processing unit 511 and a transmission processing unit 512. Each of reception processing unit 511 and transmission processing unit 512 has a function of a communication interface.

(1) Load control unit 121 controls operations of loads 130, 140 while the direct-current voltage is being provided to each load 130, 140. Specifically, load control unit 121 controls the operations of loads 130, 140 to allow the output of each load 130, 140 to fall within a predetermined range, during the operations of loads 521, 522 in post processing apparatus 50. Transmission processing unit 122 transmits an instruction for a post process, to post processing apparatus 50.

From image formation apparatus 10, reception processing unit 511 of post processing apparatus 50 receives the instruction for the post process. Transmission processing unit 512 of post processing apparatus 50 transmits, to image formation apparatus 10, a signal that is based on the instruction and indicates a timing for the post process.

From post processing apparatus 50, reception processing unit 123 receives the signal that is based on the instruction for the post process and indicates the timing for the post process. Based on the signal received by reception processing unit 123 and indicating the timing, power source control unit 124 increases the output voltage of switching power source 110. Specifically, power source control unit 124 changes the duty in the control signal for DC/DC converter 113 to increase the output of DC/DC converter 113.

Based on the signal received by reception processing unit 123 and indicating the timing, load control unit 121 controls the output of each load 130, 140 to fall within a predetermined range. The predetermined range is, for example, a range from a to 1.05$\alpha$, where $\alpha$ represents a predetermined reference for the output value of each load 130, 140. Preferably, load control unit 121 controls each load 130, 140 so that the output of each load 130, 140 becomes a when the output voltage of switching power source 110 is increased.

Meanwhile, when image formation apparatus 10 controls to increase the power to be supplied to post processing apparatus 50, the voltage supplied to each load 130, 140 in image formation apparatus 10 is temporarily increased as described above (see FIG. 3(*c*)). Further, when the voltage supplied to each load 130, 140 in image formation apparatus 10 is temporarily increased, the output of each load 130, 140 becomes unstable. As a result, an image may not be formed with precision.

However, in image formation apparatus 10, when the output voltage of switching power source 110 is increased, load control unit 121 restricts the output of each load 130, 140 to the predetermined range. This stabilizes the output of each load 130, 140 in image formation apparatus 10. As a result, image formation apparatus 10 can form an image with high precision.

(2) More specifically, reception processing unit 123 receives, from post processing apparatus 50, the voltage drop value obtained during the operations of loads 521, 522 of post processing apparatus 50. Based on the timing for the post process as well as the voltage drop value received from post processing apparatus 50, power source control unit 124 increases the output voltage of switching power source 110. On the other hand, load control unit 121 sends to HV load 130 the control signal (see FIG. 6(*b*)) for controlling the operation of HV load 130, thereby restricting the output of HV load 130 to the predetermined range.

Because image formation apparatus 10 increases the output voltage of switching power source 110 based on the voltage drop value in post processing apparatus 50, the voltage to be supplied to each load 521-523 of post processing apparatus 50 can be set at an appropriate value.

Meanwhile, the output voltage of switching power source 110 needs to be increased by a greater value when the voltage drop value is larger, and be increased by a smaller value when the voltage drop value is smaller. As such, the increase value for the output voltage is changed depending on the voltage drop value. Accordingly, the voltage to be supplied to HV load 130 of image formation apparatus 10 is changed depending on the voltage drop value. Thus, the ITV output of BY load 130 is also changed depending on the voltage drop value. In other words, the HV output of HV load 130 is changed depending on a degree of increase of the output voltage of switching power source 110.

Hence, when the control signal for controlling the operation of HV load 130 is not a signal dependent on the voltage drop value, the output of HV load 130 may fall out of the predetermined range.

In image formation apparatus 10, the control signal that is based on the voltage drop value is transmitted to HV load 130 as described above. Hence, in image formation apparatus 10, the output of HV load 130 can be restricted to the predetermined range readily and securely.

As such, it can be said that load control unit 121 is configured to control each load 130, 140 based on the voltage drop value (the above-described information indicative of the change therein). Further, it can be said that load control unit 121 is configured to control each load 130, 140 based on the degree of increase of the output voltage of switching power source 110, determined by power source control unit 124.

(3) When the direct-current voltage is dropped as a result of the operation of punch process load 523 of post processing apparatus 50, power source control unit 124 does not increase the output voltage of switching power source 110 based on the timing for the post process.

As described above, the voltage drop taking place upon the punch process is smaller than predetermined value Vth. In such a case, the process for increasing the output voltage of switching power source 110 is not necessarily required.

Hence, when the direct-current voltage is dropped due to the operation of punch process load 523, the output voltage of switching power source 110 is not increased based on the timing for the post process, thereby suppressing energy consumption.

As such, it can be said that power source control unit 124 is configured to control to increase the output voltage of switching power source 110 when the change in voltage is not less than the predetermined value (Vth) upon the operation of each load of post processing apparatus 50, and is configured not to control to increase the output voltage of switching power source 110 when the change in voltage is less than the predetermined value upon the operation of each load.

(4) Based on the timing for the post process, load control unit 121 changes the duty ratio in the PWM control for HV load 130. Specifically, load control unit 121 controls the pulse width so as to reduce the time for the on state. Accordingly, even when the voltage supplied to HV load 130 is increased, image formation apparatus 10 can restrict the output of HV load 130 to the predetermined range.

(5) Motor load 140 includes a pulse motor (not shown), and a first feedback circuit (not shown) and a second feedback circuit (not shown) each for controlling the motor through feedback. The first feedback circuit and the second feedback circuit are switched therebetween by a switch so as to connect one of them to the pulse motor. Further, the first feedback circuit has a feedback gain larger than that of the second feedback circuit. It should be noted that in a default state, the first feedback circuit is connected to the pulse motor.

Load control unit 121 switches, based on the timing for the post process, from the first feedback circuit to the second feedback circuit so as to connect the second feedback circuit to the pulse motor.

Meanwhile, the pulse motor and the first feedback circuit constitute a first unit, and the pulse motor and the second feedback circuit constitute a second unit. Each of the first and second units may provide a varied output such as varied rotational frequency or varied torque of the pulse motor even during the feedback control, when the driving voltage for the pulse motor (i.e., the output voltage of DC/DC converter 113) is increased.

In image formation apparatus 10, as described above, based on the timing for the post process, load control unit 121 switches from the first feedback circuit to the second feedback circuit so as to connect the second feedback circuit to the pulse motor. Here, the feedback gain of the second feedback circuit is smaller than the feedback gain of the first feedback circuit, thereby allowing load control unit 121 to reduce fluctuations of the output of the pulse motor. Hence, even when the voltage supplied to the pulse motor is increased, image formation apparatus 10 can restrict the output of the pulse motor to the predetermined range.

The description above has illustrated the case where image formation apparatus 10 is configured to have the two feedback circuits (first feedback circuit and second feedback circuit), but image formation apparatus 10 may be configured to have three or more feedback circuits different in feedback gain. Further, image formation apparatus 10 may be configured as follows.

That is, the image formation apparatus is configured to include one feedback circuit. Further, the feedback circuit has a feedback gain that is not fixed to one value and can be changed among a plurality of values. Based on the timing for the post process, load control unit 121 performs a process of reducing the feedback gain. Such a configuration also provides an effect similar to that provided by the configuration including the plurality of feedback circuits.

(6) When shift process load 521 and/or stapling process load 522 perform a first post process after the transmission of the instruction for the post process, power source control unit 124 increases the output voltage of switching power source 110 by the predetermined value. On the other hand, when shift process load 521 and/or stapling process load 522 perform a second post process, power source control unit 124 corrects the predetermined value based on the voltage drop value in the first post process.

Hence, even when the increase value of the output voltage is not optimum in the first post process, the increase value is corrected based on the voltage drop value in the first post process, thereby allowing the increase value to be close to an optimum increase value.

<Control Structure>

Figure 8:
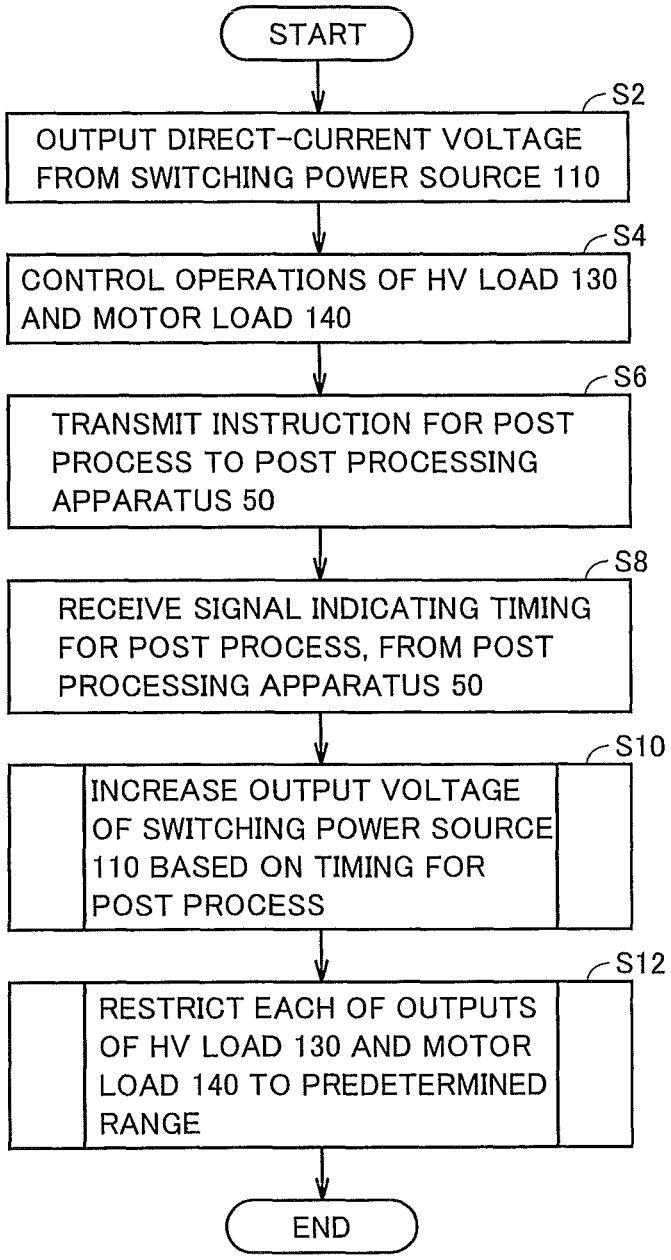
FIG. 8 is a flowchart showing a flow of processes in the image formation apparatus.

FIG. 8 is a flowchart showing a flow of processes in image formation apparatus 10. The processes shown in FIG. 8 as well as below-described processes shown in FIG. 9 and FIG. 10 are performed by control unit 120 executing a program stored in a ROM or the like.

Referring to FIG. 8, in step S2, control unit 120 causes switching power source 110 to output the direct-current voltage (24V) to each load 130, 140, 521-523. In step S4, after switching power source 110 has started to output, control unit 120 controls the operations of HV load 130 and motor load 140.

In step S6, control unit 120 transmits the instruction for the post process, to post processing apparatus 50. In step S8, from post processing apparatus 50, control unit 120 receives the signal indicating the timing for the post process. In step S10, based on the timing for the post process, power source control unit 124 of control unit 120 increases the output voltage of switching power source 110. In step S12, load control unit 121 of control unit 120 restricts each of the outputs of HV load 130 and motor load 140 to the predetermined range.

Figure 9:
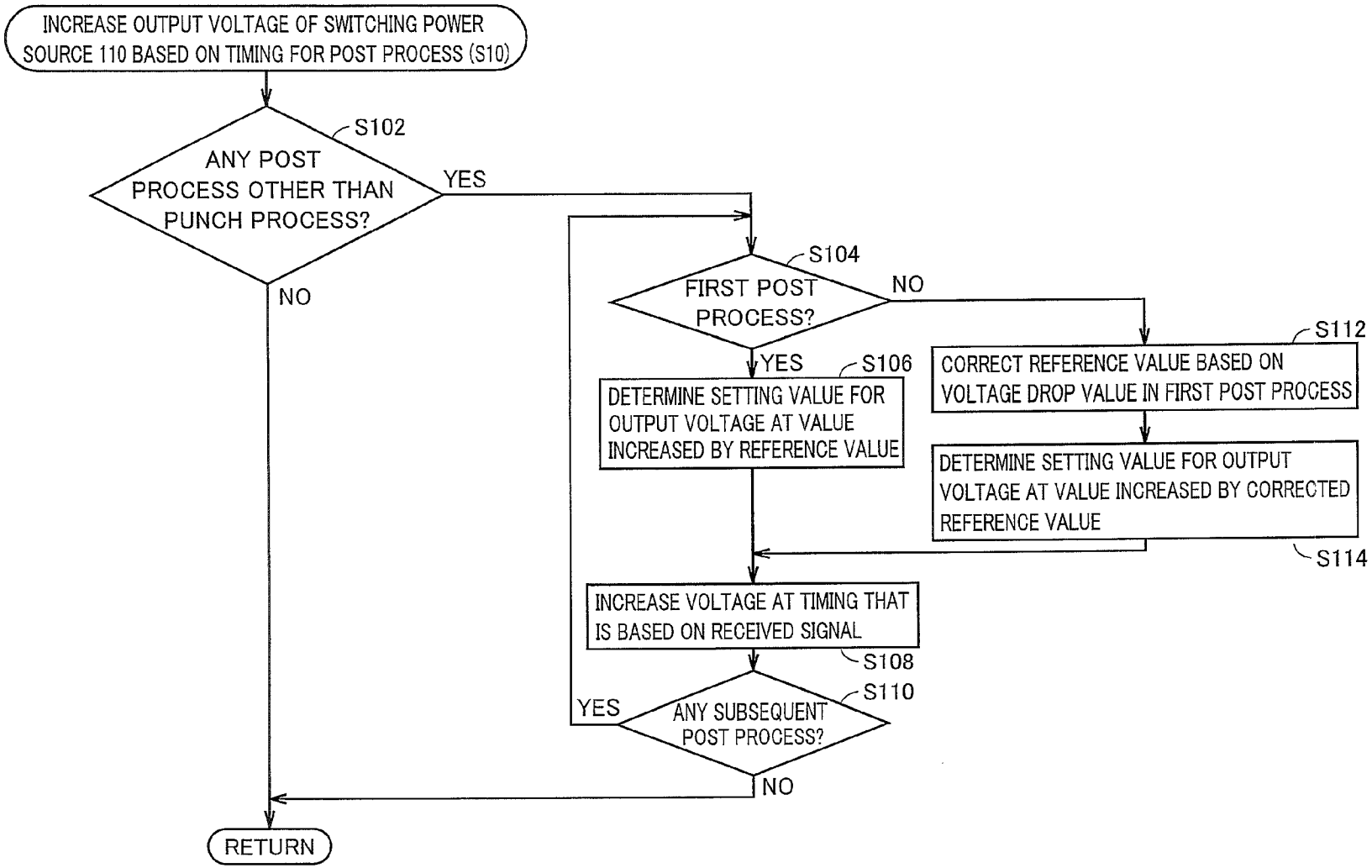
FIG. 9 is a flowchart showing details of step S10 of FIG. 8.
Figure 10:
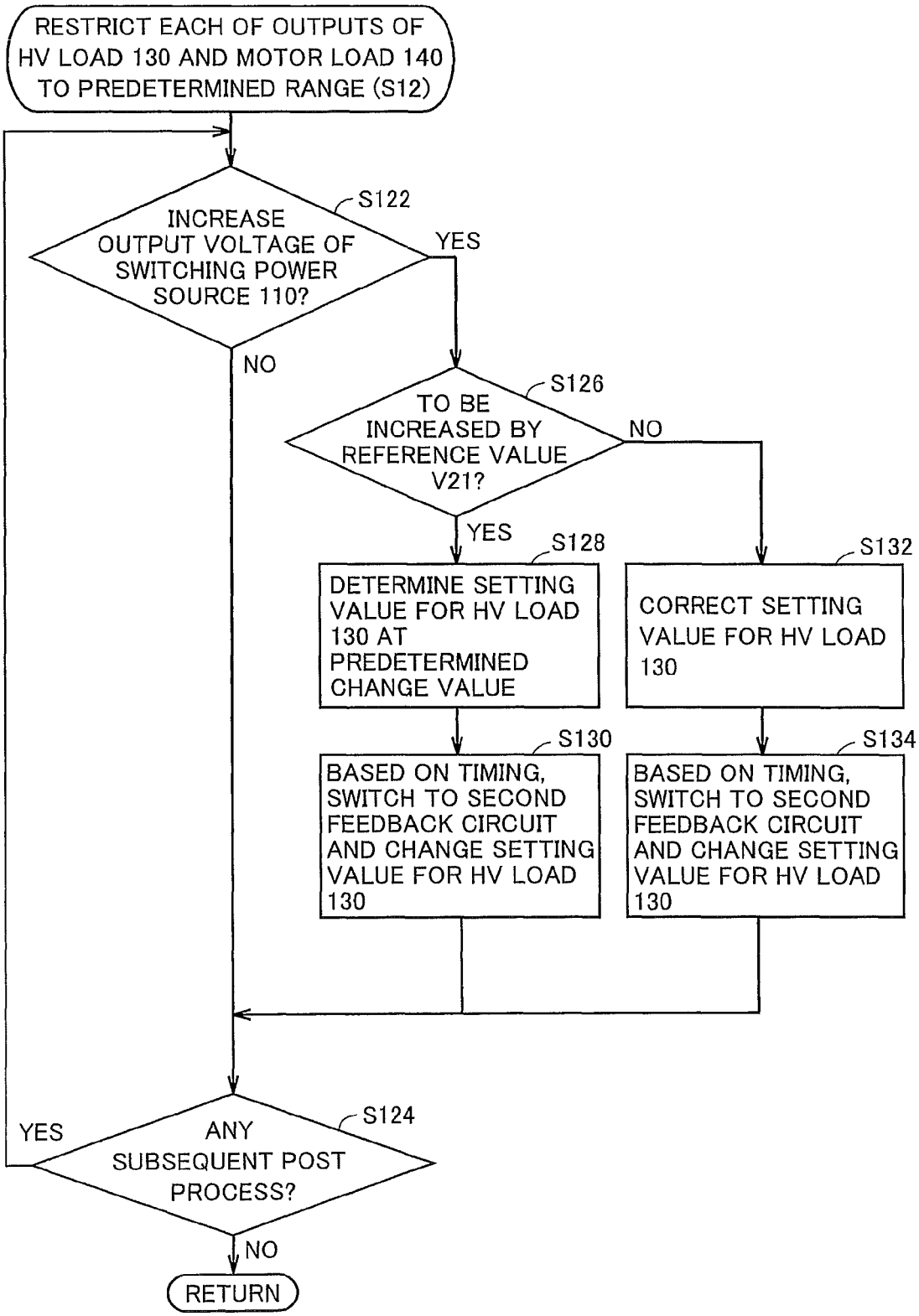
FIG. 10 is a flowchart showing details of step S12 of FIG. 8.

FIG. 9 is a flowchart showing details of step S10 shown in FIG. 8. Referring to FIG. 9, in step S102, control unit 120 determines whether or not the instructed post process includes a post process other than the punch process. When control unit 120 determines that no post process other than the punch process is included (NO in step S102), control unit 120 terminates the process shown in the flowchart, and brings the process to step S12 shown in the flowchart of FIG. 8. When control unit 120 determines that a post process other than the punch process is included therein (YES in step S102), the process goes to step S104.

In step S104, power source control unit 124 determines whether or not the post process to be performed is a first post process. It should be noted that the term "first post process" herein refers to a post process to be performed first in one job instructed by a user. When power source control unit 124 determines that the post process is the first post process (YES in step S104), in step S106, power source control unit 124 determines, at a value increased from the default value (24V) by reference value V21 (see FIG. 5), the setting value for the output voltage of DC/DC converter 113 upon performing the post process. In step S108, power source control unit 124 increases the output voltage of DC/DC converter 113 at the timing that is based on the signal received from post processing apparatus 50.

In step S110, power source control unit 124 determines whether or not there is a subsequent post process. When power source control unit 124 determines that there is a subsequent post process (YES in step S110), the process goes to step S104. On the other hand, when power source control unit 124 determines that there is no subsequent process (NO in step S110), the process in this flowchart is terminated and the process goes to step S12 shown in the flowchart of FIG. 8.

When power source control unit 124 determines that the post process is not the first post process (NO in step S104), in step S112, power source control unit 124 corrects the reference value based on the voltage drop value in the first post process. In step S114, power source control unit 124 determines, at a value increased from the default value (24V) by the corrected reference value, the output voltage of the DC/DC converter 113 upon performing the post process.

FIG. 10 is a flowchart showing details of step S12 shown in FIG. 8. Referring to FIG. 10, in step S122, control unit 120 determines whether to increase the output voltage of switching power source 110. When control unit 120 determines that the output voltage is not to be increased (NO in step S122), in step S124, control unit 120 determines whether or not there is a subsequent post process. In this case, the setting value for HV load 130 is not changed and switching between the feedback circuits is not performed. On the other hand, when control unit 120 determines that the output voltage is to be increased (YES in step S122), in step S126, control unit 120 determines whether to increase the output voltage by reference value V21.

When the output voltage is to be increased by reference value V21 (YES in step S126), in step S128, load control unit 121 determines the setting value for HV load 130 at a predetermined change value. In step S130, load control unit 121 switches, at the timing that is based on the signal indicating the timing for the post process, from the first feedback circuit to the second feedback circuit so as to connect the second feedback circuit to the pulse motor, and changes the setting value for HV load 130 at the same timing.

When the output value is not to be increased by reference value V21 (NO in step S126), in step S132, load control unit 121 corrects the setting value for HV load 130 to a value corresponding to the corrected increase value of the power source voltage. In step S134, at the timing that is based on the signal indicating the timing for the post process, load control unit 121 switches from the first feedback circuit to the second feedback circuit so as to connect the second feedback circuit to the pulse motor, and changes the setting value for HV load 130 to the corrected setting value at the same timing.

It should be noted that transferring device 3, which serves as HV load 130, is driven by the motor to rotate, and it can be therefore said that transferring device 3 also serves as the motor load.

The description above has illustrated the configuration in which switching power source 110 supplies the voltage of "+24 V" to HV load 130 and HV generating circuit 131 generates the HV with positive polarity from the voltage of "+24V". However, the present invention is not limited to such a configuration. For example, the present invention is applicable to a configuration in which switching power source 110 supplies a voltage of "−24 V" to HV load 130 and HV generating circuit 131 generates a HV with negative polarity from the voltage of "−24V". In other words, also in the case where switching power source 110 supplies the voltage of "−24 V" to post processing apparatus 50, control similar to that in the case of supplying the voltage of "+24 V" can be performed. In addition, the present invention is also applicable to a configuration in which switching power source 110 supplies a voltage of "±24 V" to HV load 130.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image formation apparatus connectable to a post processing apparatus for performing a post process to a sheet, comprising:

a power source for outputting an equal voltage to a first load and a second load in parallel, said first load being provided in said image formation apparatus and being involved in image formation, said second load being provided in said post processing apparatus and being involved in said post process;

a power source controller for increasing the output voltage of said power source during an operation of said second load so that a voltage drop supplied to the second load is reduced; and a load controller for controlling an operation of said first load such that an output of said first load falls within a predetermined range during the operation of said second load when the output voltage of said power source is increased by the power source controller and when the increase of output voltage of said power source causes a temporary increase in voltage supplied to the first load and the second load.

2. The image formation apparatus according to claim 1, wherein said first load is an HV load including a developing device or a transferring device.

3. The image formation apparatus according to claim 1, wherein said first load includes a motor load for driving a transporting unit for transporting a sheet on which an image is to be formed.

4. The image formation apparatus according to claim 1, wherein said second load is a stapling process load for providing a stapling process to a sheet having an image formed thereon, or a shift process load for providing a shift process to the sheet having the image formed thereon.

5. The image formation apparatus according to claim 1, further comprising a communication interface for receiving, from said post processing apparatus, information indicating a change in said voltage supplied to said second load during the operation of said second load, wherein based on said information indicating the change, said power source controller determines a degree of increase of the output voltage of said power source.

6. The image formation apparatus according to claim 5, wherein based on said information indicating the change, said load controller controls the operation of said first load.

7. The image formation apparatus according to claim 5, wherein said load controller controls the operation of said first load based on the degree of increase of the output voltage of said power source, the degree of increase having been determined by said power source controller.

8. The image formation apparatus according to claim 1, wherein when a change in the voltage during the operation of said second load is not less than a predetermined value, said power source controller controls to increase the output voltage of said power source, and when the change in the voltage during the operation of said second load is less than the predetermined value, said power source controller does not control to increase the output voltage of said power source.

9. The image formation apparatus according to claim 1, wherein:

the operation of said first load is controlled by modulating a pulse width of a control signal input thereto, and said load controller controls the operation of said first load by changing a duty ratio in said control signal.

10. The image formation apparatus according to claim 5, wherein:

during a first operation of said second load, said power source controller increases the output voltage of said power source by a predetermined degree, and during a second or later operation of said second load, said power source controller corrects said predetermined degree based on a change, taking place at a timing of said first operation, in the voltage supplied to said second load, and increases the output voltage of said power source by the predetermined degree thus corrected.

11. An image formation system comprising a post processing apparatus for performing a post process to a sheet, and an image formation apparatus connected to said post processing apparatus, said image formation apparatus including a power source for outputting an equal voltage to a first load and a second load in parallel, said first load being provided in said image formation apparatus and being involved in image formation, said second load being provided in said post processing apparatus and being involved in said post process, a power source controller for increasing the output voltage of said power source during an operation of said second load so that a voltage drop supplied to the second load is reduced, and a load controller for controlling an operation of said first load such that an output of said first load falls within a predetermined range during the operation of said second load when the output voltage of said power source is increased by the power source controller and when the increase of output voltage of said power source causes a temporary increase in the voltage supplied to the first load and the second load, said post processing apparatus transmitting, to said image formation apparatus, information indicating a change in said voltage supplied to said second load during the operation of said second load, said image formation apparatus receiving said information indicating the change, from said post processing apparatus, said power source controller determining, based on said information indicating the change, a degree of increase of the output voltage of said power source.

12. The image formation system according to claim 11, wherein said first load is an HV load including a developing device or a transferring device.

13. The image formation system according to claim 11, wherein said first load includes a motor load for driving a transporting unit for transporting a sheet on which an image is to be formed.

14. The image formation system according to claim 11, wherein said second load is a stapling process load for providing a stapling process to a sheet having an image formed thereon, or a shift process load for providing a shift process to the sheet having the image formed thereon.

15. The image formation system according to claim 11, wherein said load controller controls the operation of said first load based on said information indicating the change.

16. The image formation system according to claim 11, wherein said load controller controls the operation of said first load based on the degree of increase of the output voltage of said power source, the degree of increase having been determined by said power source controller.

17. The image formation system according to claim 11, wherein when the change in the voltage during the operation of said second load is not less than a predetermined value, said power source controller controls to increase the output voltage of said power source, and when the change in the voltage during the operation of said second load is less than the predetermined value, said power source controller does not control to increase the output voltage of said power source.

18. The image formation system according to claim 11, wherein:

the operation of said first load is controlled by modulating a pulse width of a control signal input thereto, and said load controller controls the operation of said first load by changing a duty ratio in said control signal.

19. The image formation system according to claim 11, wherein:

during a first operation of said second load, said power source controller increases the output voltage of said power source by a predetermined degree, and during a second or later operation of said second load, said power source controller corrects said predetermined degree based on a change, taking place at a timing of said first operation, in the voltage supplied to said second load, and increases the output voltage of said power source by the predetermined degree thus corrected.

20. An output control method in an image formation apparatus connectable to a post processing apparatus for performing a post process to a sheet, the output control method comprising the steps of:

a power source of said image formation apparatus outputting an equal voltage to a first load and a second load in parallel, said first load being provided in said image formation apparatus and being involved in image formation, said second load being provided in said post processing apparatus and being involved in said post process;

a controller of said image formation apparatus increasing the output voltage of said power source during an operation of said second load so that a voltage drop supplied to the second load is reduced; and said controller controlling an operation of said first load such that an output of said first load falls within a predetermined range during the operation of said second load when the output voltage of said power source is increased by the power source controller and when the increase of output voltage of said power source causes a temporary increase in the voltage supplied to the first load and the second load.

21. The output control method according to claim 20, wherein said first load is an HV load including a developing device or a transferring device.

22. The output control method according to claim 20, wherein said first load includes a motor load for driving a transporting unit for transporting a sheet on which an image is to be formed.

23. The output control method according to claim 20, wherein said second load is a stapling process load for providing a stapling process to a sheet having an image formed thereon, or a shift process load for providing a shift process to the sheet having the image formed thereon.

24. The output control method according to claim 20, further comprising the step of said controller receiving, from said post processing apparatus, information indicating a change in said voltage supplied to said second load during the operation of said second load, wherein the step of increasing said output voltage includes the step of said controller determining a degree of increase of the output voltage of said power source based on said information indicating the change.

25. The output control method according to claim 24, wherein in the step of controlling the operation of said first load, said controller controls the operation of said first load based on said information indicating the change.

26. The output control method according to claim 24, wherein in the step of controlling the operation of said first load, said controller controls the operation of said first load based on the determined degree of increase of the output voltage of said power source.

27. The output control method according to claim 20, wherein the step of increasing said output voltage includes the steps of:

said controller controlling to increase the output voltage of said power source when a change in the voltage during the operation of said second load is not less than a predetermined value, and said controller not controlling to increase the output voltage of said power source when the change in the voltage during the operation of said second load is less than the predetermined value.

28. The output control method according to claim 20, wherein:

the operation of said first load is controlled by modulating a pulse width of a control signal input thereto, and in the step of controlling the operation of said first load, said controller controls the operation of said first load by changing a duty ratio in said control signal.

29. The output control method according to claim 24, wherein the step of increasing said output voltage further includes the steps of:

during a first operation of said second load, said controller increasing the output voltage of said power source by a predetermined degree, and during a second or later operation of said second load, said controller correcting said predetermined degree based on a change, taking place at a timing of said first operation, in the voltage supplied to said second load, and increasing the output voltage of said power source by the predetermined degree thus corrected.

* * * * *